US007469482B2

(12) United States Patent
Hickey et al.

(10) Patent No.: US 7,469,482 B2
(45) **Date of Patent: *Dec. 30, 2008**

(54) LAY OUT LINE

(75) Inventors: James Karl Hickey, Greencastle, PA (US); Michael Thomas Cranston, Greencastle, PA (US)

(73) Assignee: Studline Tool Company, Greencastle, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/763,792

(22) Filed: Jun. 15, 2007

(65) Prior Publication Data

US 2007/0240320 A1 Oct. 18, 2007

Related U.S. Application Data

(63) Continuation-in-part of application No. 11/265,643, filed on Nov. 2, 2005, now Pat. No. 7,231,722.

(60) Provisional application No. 60/669,284, filed on Apr. 7, 2005, provisional application No. 60/625,462, filed on Nov. 5, 2004.

(51) Int. Cl.
*B44D 3/38* (2006.01)

(52) U.S. Cl. ..... 33/414; 33/1 LE

(58) Field of Classification Search ..... 33/413, 33/414, 756, 771, 34, 38, 39.1, 1 LE
See application file for complete search history.

(56) References Cited

U.S. PATENT DOCUMENTS

| | | | | |
|---|---|---|---|---|
| 1,838,383 | A | 12/1931 | Fridolph | |
| 2,133,327 | A | 10/1938 | Slayter et al. | |
| 2,602,233 | A | 7/1952 | Irving | |
| 3,078,755 | A * | 2/1963 | Chace, Jr. | 87/9 |
| 3,451,305 | A * | 6/1969 | Johnson et al. | 87/6 |
| 4,034,547 | A * | 7/1977 | Loos | 57/211 |
| 4,152,836 | A | 5/1979 | Rodrique | |
| 4,233,749 | A | 11/1980 | Coulter et al. | |
| 4,353,167 | A | 10/1982 | Martin | |
| 4,660,291 | A | 4/1987 | Dehn | |
| 4,679,325 | A | 7/1987 | Sweatman | |
| 4,819,337 | A | 4/1989 | Noyes | |
| 4,845,858 | A | 7/1989 | Thomas | |
| 4,912,781 | A * | 4/1990 | Robins et al. | 2/2.5 |
| 5,038,492 | A | 8/1991 | Bryant et al. | |
| 5,163,230 | A | 11/1992 | Gast | |
| 5,280,921 | A * | 1/1994 | Milburn | 33/759 |
| 5,416,978 | A * | 5/1995 | Kaufman | 33/770 |
| 6,341,743 | B1 | 1/2002 | Haas | |
| 6,826,845 | B2 | 12/2004 | Pritchard | |
| 7,231,722 | B2 * | 6/2007 | Hickey et al. | 33/414 |
| 2002/0088133 | A1 * | 7/2002 | McMillan | 33/756 |

* cited by examiner

*Primary Examiner*—G. Bradley Bennett
*Assistant Examiner*—Amy Cohen Johnson
(74) *Attorney, Agent, or Firm*—Duane Morris LLP

(57) ABSTRACT

A chalk line apparatus for marking regularly spaced locations. The apparatus comprises a casing for powdered chalk containing a rotatable reel, line wound on said reel, and an exit opening for the line at one end of the holder. The line has evenly spaced short segments disposed thereon so that when the line is tensioned to a predetermined level of about 10-15 lbs, the segments reside at precisely placed predetermined intervals. When the line is snapped, chalk marks are placed on the wall surface in a pattern that identifies the appropriate locations of underlying wall studs.

20 Claims, 13 Drawing Sheets

LAY OUT LINE

CROSS REFERENCE TO RELATED APPLICATIONS

This is a continuation-in-part application of non-provisional patent application Ser. No. 11/265,643, filed Nov. 2, 2005, by Hickey et al., titled "Lay Out Line," which is a non-provisional patent application of U.S. provisional patent applications 60/669,284, filed Apr. 7, 2005, by Hickey et al., titled "Lay Out Line," and 60/625,462, filed Nov. 5, 2004, by Hickey et al., titled "Layout Line," the entirety of which applications are expressly incorporated herein.

FIELD OF THE INVENTION

The present invention generally relates to devices for depositing calibrated chalk markings on construction surfaces, and more particularly for depositing a line of chalk with visibly distinct markings at even intervals along its length for indicating the location of underlying wall studs.

BACKGROUND OF THE INVENTION

In the construction trades and in related fields, it is a constant requirement to position studs, posts, walls, partitions, beams, bolts and a variety of other building materials at predetermined and accurate distances from each other and in a straight line or coplanar to each other. In residential and commercial construction all wall studs, door joists, and roof rafters are placed at exact locations in the structure of the building, and in registration with one another, during construction so as to provide structural support for the building. These structural elements also provide support for interior and exterior surface elements and sheeting materials, such as, drywall, plywood, flooring, exterior siding, insulation, and the like. For example, dry wall is normally screwed or nailed to wall studs so as to form the interior surfaces of a room. Since sheeting materials are manufactured in forty-eight inch widths, the required stud spacing is always a divisor of forty-eight, and is usually sixteen inches to the center of each stud, although occasionally it is twelve, twenty-four, or nineteen and two tenths-inches.

In some instances, the method by which workman precisely locate wall studs, joists, or rafters along walls, the floor or ceiling, or the roof involves extending a tape measure along a portion of the structure so as to find and mark each stud, joist, or rafter location, e.g., at sixteen inch or twelve inch increments along a surface of the structure. Each discrete location is often marked with a pencil, e.g., by an "X," denoting each appropriate position for a stud to be placed. Finally, a carpenter's square is employed to draw a line perpendicularly through each discrete location to allow for stud alignment. The workman is usually on his or her knees or on a ladder during this process, which adds to its already slow and cumbersome nature.

In another prior art method for laying out regularly spaced structural elements, two separate operations are employed requiring two separate devices. In a first step, a straight line is applied along a surface of the structure using a conventional chalked string or "chalk-line" string. A chalk-line string often consists of a length of chalk-receptive string that is wound upon a spool. The chalk-line string is coated with a red or blue chalk powder directly or, by rubbing the string against a piece of marking chalk, so that chalk particles become entrapped within the porous body of the string. In this way, the chalk-line string may be unwound from the spool and fastened adjacent to a surface of the structure to be marked. The extended chalk-line string is then drawn outwardly, in the manner of a bow string, so that it may be snapped against the surface. As a result, some of the chalk particles are transferred onto the surface thereby creating a straight chalk line marking on the surface that is coincident with the overlying position of the chalk-line string.

The next step employs a measuring device, such as a folding wooden ruler or a flexible, retractable metallic measuring tape. The measuring device is aligned with the chalk line marking and additional, periodic marks are applied manually to the surface to indicate predetermined, accurately-spaced distances along the chalk line marking. In the case of wall studs, such marks generally are spaced from each other by exactly sixteen inches. A workman relies upon the manually-applied marks to indicate, for instance, the relative positions of studs which he erects as a support for a straight wall.

It has been proposed to combine both of these steps by applying over the chalk-line string a number of spaced narrow applications of paint to render the narrow spaced areas non-receptive or non-absorbing to chalk powder. When applied to a surface as previously outlined, such a chalk-line string provides a continuous chalk line marking which is periodically interrupted by narrow voids which are spaced from each other by predetermined distances. The disadvantages of such chalk-line strings are manifold. Firstly, such prior art chalk-line strings do not provide reliably-spaced indicia because the length of a string will vary (i.e., stretch or shrink) to some extent with changes in temperature and humidity; strings increase in length or stretch when under tension, e.g., during snapping, and strings increase in length and become weak after prolonged use. Secondly, such chalk-line strings provide narrowly spaced voids or chalk-free areas which are difficult to locate along the chalk line marking unless they are spaced fairly wide apart, in which case they do not provide an accurate measurement guide. Also, if the chalk line marking is weak in intensity and/or is inadvertently contacted or smeared, voids may appear in unintended areas which can mislead the workman. In other words, a positive mark is more reliable than the absence of a mark. Furthermore, paint or other materials applied to the string surface can wear off, particularly under the effects of repeated transport of the string through the narrow eyelet provided on most prior art devices.

Thus, there is a need for a locator line for reliably, precisely, and repeatably marking the locations on a surface to indicate predetermined, accurately-spaced distances along the line.

SUMMARY OF THE INVENTION

An apparatus for applying a plurality of regularly spaced marks to a surface is disclosed. The apparatus may comprise a wire rope defining an interior void so that a predetermined applied tensile force causes said wire rope to compress radially and thereby produce a pretensioning limit beyond which said wire rope resists axial stretching. The wire rope may have (i) a relaxed configuration, and (ii) a tensed configuration in which said predetermined tensile force is substantially axially applied to an end of said wire rope so as to thereby reach said pretensioning limit. The wire rope further may have a length that is shorter in said relaxed configuration than in said tensed configuration. A plurality of surface discontinuities may be spaced at predetermined intervals along a length of said wire rope, each of said surface discontinuities being receptive to a chalk so that said chalk is (a) selectively adhered to each of said surface discontinuities but (b) repelled by portions of said wire rope located between adjacent surface discontinuities thereby producing a multiplicity of aligned, accurately spaced chalk marks on a surface when said wire rope is snapped against said surface in said tensed configuration.

A tensioned chalk line apparatus is further disclosed, comprising: a chalk line comprising a multi-strand line, said chalk line having a relaxed configuration in which substantially no tensile force is applied to said chalk line and a tensed configuration in which a predetermined tensile force is applied to an end of said chalk line, said chalk line further having a length that is shorter in said relaxed configuration than in said tensed configuration. The chalk line may further have a plurality of surface discontinuities spaced at predetermined intervals along a length of said chalk line. At least one of said plurality of surface discontinuities may comprise a thin layer of material having a surface reppelant to a chalk material so that chalk is repelled by said surface discontinuities and is selectively adhered to portions of said chalk line located between adjacent surface discontinuities to provide a chalk line capable of producing a multiplicity of aligned, accurately spaced chalk marks on a surface in said tensed configuration.

BRIEF DESCRIPTION OF THE DRAWINGS

These and other features and advantages of the present invention will be more fully disclosed in, or rendered obvious by, the following detailed description of the preferred embodiments of the invention, which are to be considered together with the accompanying drawings wherein like numbers refer to like parts and further wherein.

DETAILED DESCRIPTION OF THE PREFERRED EMBODIMENT

Figure 1:
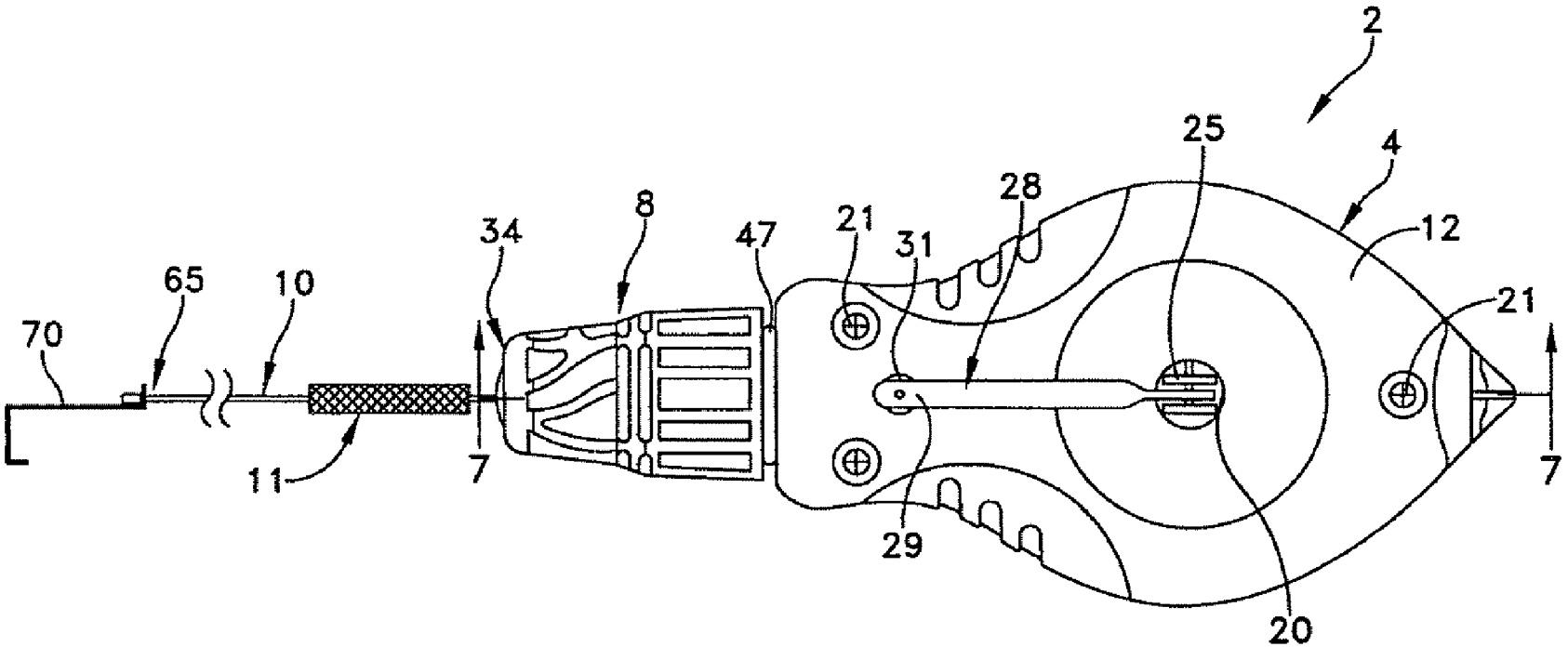
FIG. 1 is a side elevational view of an assembled lay out line formed in accordance with the present invention.
Figure 3:
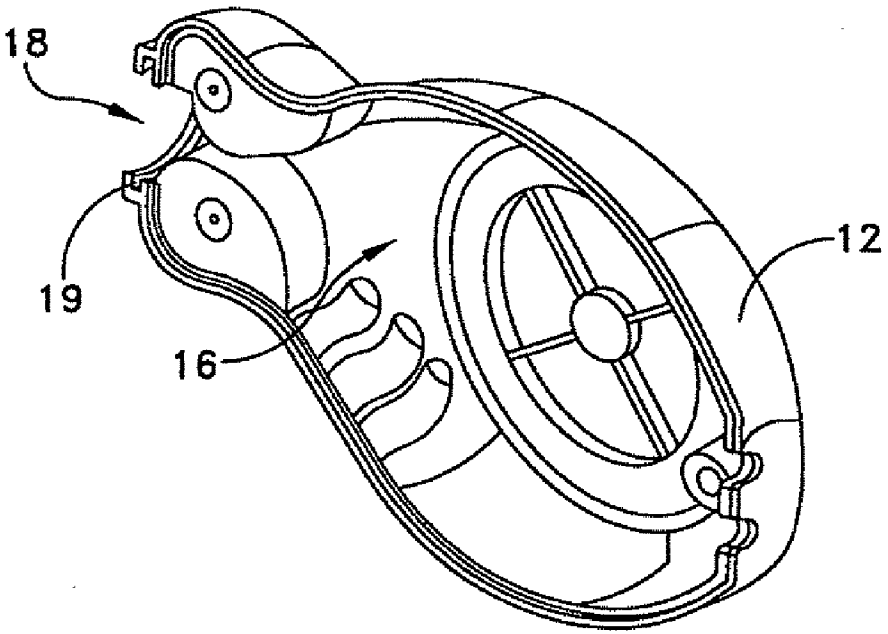
FIGS. 2 and 3 are perspective views of first and second housing halves that form a portion of a housing assembly of the lay out line shown in FIG. 1.
Figure 2:
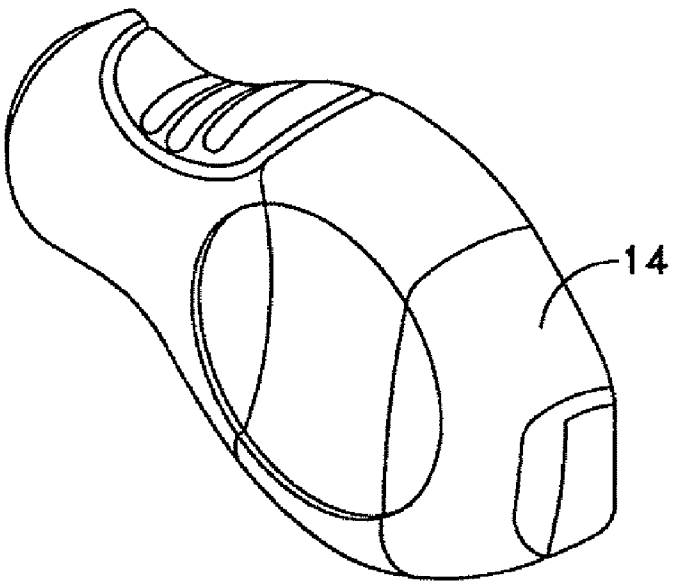

This description of preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

Referring to FIGS. 1-4, a lay out line 2 formed in accordance with the present invention comprises a housing assembly 4, a spool 6, a nose piece 8, and a line 10 having transfer mark regions 11. More particularly, housing assembly 4 has an ergonomically shaped outer surface suitable for holding in one hand, and includes a first housing half 12 and a second housing half 14. A chamber or cavity 16 is defined between first housing half 12 and second housing half 14 that is sized and shaped for receiving spool 6 and a quantity of powdered chalk (not shown). An opening 18 is defined at one end of housing assembly 4 with a locking recess 19, and a side opening 20 is defined in a central portion of housing half 12, both of which communicate with chamber 16. Housing halves 12, 14 are often approximately mirror images of one another, and are joined together by releasable fasteners, e.g., screws 21. In a preferred embodiment, nose piece 8 and housing halves 12, 14 are injection molded from a nylon composition containing about thirty-three percent fiberglass, and about six percent polytetrafluorethylene (PTFE) e.g., Lubricomp Sten FL 4036 HS, manufactured by General Electric Plastics. This composition has been found to resist degradation due to abrasion and heat from line 10, which in normal use is created when line 10 is reeled into housing assembly 4 at a high rate of speed. Due to the rugged and durable nature of the foregoing polymer composition, additional metal wear rings, etc., are not usually required, although they may be used in some instances without deviating from the scope of the present invention. Additionally, this polymer composition is also light, minimizing the overall weight of the device.

Figure 4:
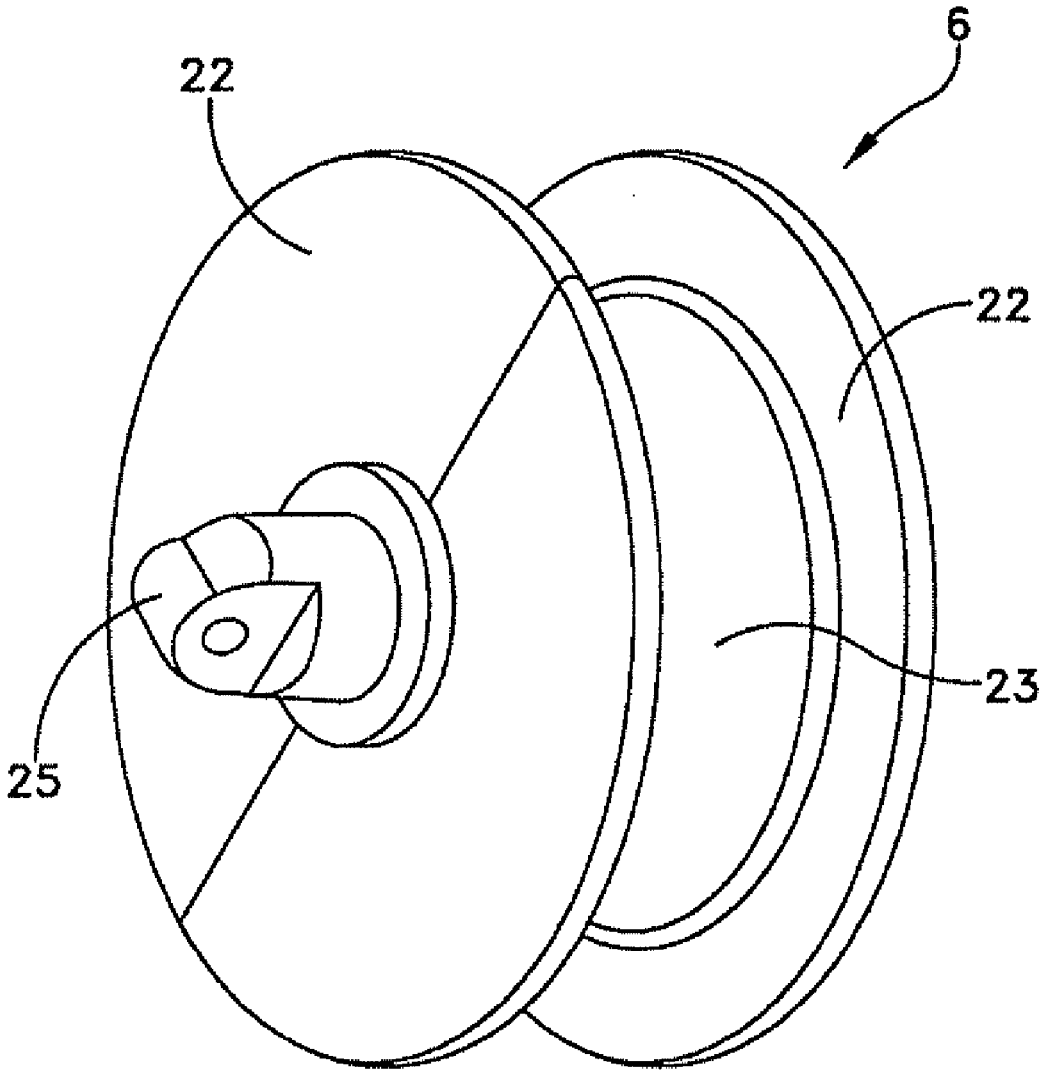
FIG. 4 is a perspective view of a spool.
Figure 5:
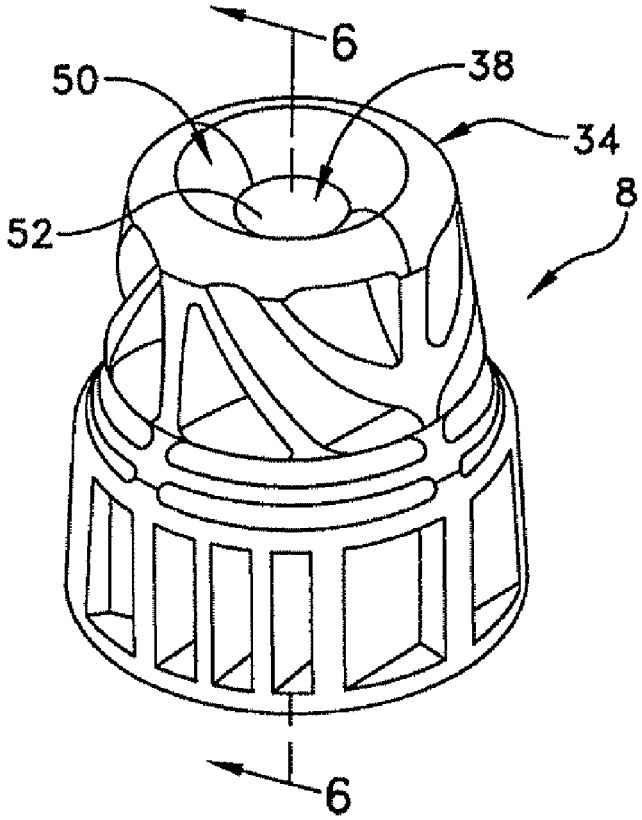
FIGS. 5 and 6 are a perspective and cross-sectional view, respectively, of a nose piece.
Figure 6:
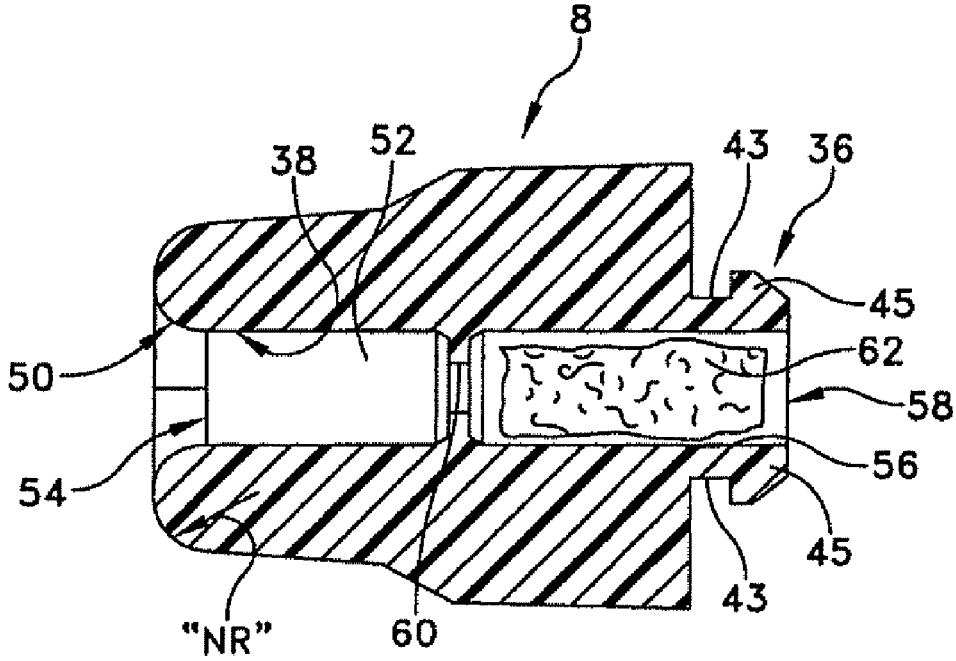

Referring to FIG. 4, spool 6 includes spaced-apart flanges 22 having central cylinder 23 positioned between them. Spool 6 is sized so as to be rotatably received within chamber 16 when first housing half 12 and second housing half 14 are assembled to one another to form housing assembly 4, and with about twenty-five feet or so of line 10 wound onto central cylinder 23. Significantly, the diameter of central cylinder 23 is often about one and three-quarter inches so as to minimize the bending radius of stored line 10. Spool 6 often includes an axially projecting stem 25 that projects outwardly from the center of a flange 22 and through opening 20 in first housing half 12. Stem 25 is adapted to receive a portion of an external crank handle 28, which when rotated, causes spool 6 to revolve within housing assembly 4. A free end 29 of crank handle 28 is often selectively received within a corresponding recess 31 defined in the outer surface of first housing half 12 to rotationally lock spool 6 in a selected position.

Referring to FIGS. 1, 5, 6, and 7, nose piece 8 has a discharge end 34, mounting end 36, and an axial through-bore 38 that communicates between discharge end 34 and second end 36. Discharge end 34 serves as an exit port for line 10 while mounting end 36 is configured on an outer surface so as to be received by recess 19 of housing assembly 4 adjacent to opening 18. More particularly, mounting end 36 of nose piece 8 often includes a wall 43 projecting axially outwardly and having a shoulder 45 which extends laterally from an end portion of wall 43. Shoulder 45 is sized and shaped for engaging complementary recess 19 defined adjacent to opening 18 by first and second housing halves 12, 14 so as to allow nose piece 8 to be locked and unlocked from housing assembly 4 by a simple 90-degree rotation. An elastomeric o-ring 47 (FIGS. 1 and 7) is often positioned at the interface of nose piece 8 and housing assembly 4 so as to prevent chalk leakage from between the two housing halves. This can be particularly advantageous during tensioning of line 10, where a transverse force is applied to nose piece 8 by line 10. This force may tend to "open up" the joint between nose piece 8 and housing assembly 4, which could lead to unwanted chalk leakage onto work surfaces. Flexible o-ring seal 47 ensures that the joint remains sealed even where small relative displacements occur between housing assembly 4 and nose piece 8. In one embodiment, a ⅛-inch thick neoprene o-ring 47 has been used to provide the desired flexible sealing with adequate results. Chalk may be added to lay out line 2 by disengaging nose piece 8 and pouring powdered chalk into chamber 16 through opening 18 of housing assembly 4. In one embodiment, nose piece 8 may be color coded to allow the user to easily select between line locators having different transfer mark region spacings. For example, a lay out line 2 having a sixteen inch spacing between transfer mark regions 11 can have a black color, while a lay out line 2 having a twenty-four inch spacing can have a gray color. This arrangement allows for quick selection between multiple devices at the job site, without the need to read labels.

Still referring to FIGS. 1, 5, 6, and 7, discharge end 34 of nose piece 8 defines a bearing surface 50 having a radiused profile to ensure smooth bending of line 10 during tensioning and to prevent kinking. Bearing surface 50 is gently rounded or radiused to prevent transfer mark regions 11 of line 4 from "snagging" on nose piece 8 when line 10 is being reeled into housing assembly 4. In one embodiment, the radius "NR" defining bearing surface 50 is about three-sixteenths of an inch. Axial through-bore 38 is defined by a front cavity 52 having a discharge opening 54, a rear cavity 56 having an entry opening 58, and a interconnecting throat 60. Discharge opening 54 of front cavity 52 is defined by bearing surface 50 while entry opening 58 is defined by walls 43. Front cavity 52 communicates with rear cavity 56 through interconnecting throat 60. A chalk wiping element 62 is often provided within rear cavity 56 of nose piece 8. In operation, wiping element 62 serves the multiple purposes of wiping accumulated powdered chalk material from the coated surfaces of line 10 and retaining that loose chalk within chamber 16 while squeezing chalk material into transfer mark regions 11.

In one embodiment, wiping element 62 may comprise a foam elastomer plug having an outer diameter dimension slightly larger than the inner diameter dimension of rear cavity 56 so as to be self retaining. Interconnecting throat 60 has diameter that is less than the internal diameter of front cavity 52 and rear cavity 56, and is defined at substantially the midpoint of axial through-bore 38 to prevent axial movement of wiping element 62 when line 10 is being dispensed. Also, the inlet and outlet surfaces that define throat 60 may be chamfered to facilitate movement of transfer mark regions 11 through throat 60 without snagging. Axial movement of wiping element 62 during retraction of line 10 is likewise prevented by internal web structures 63 provided on housing halves 12,14. In a preferred embodiment, wiping element 62 is a short length of Ethylene Propylene Diene Monomer (EPDM) foam cord material, cut to length and slit radially halfway through its diameter. Using an EPDM plug provides the advantage that it will not readily "catch" transfer mark regions 11 when line 10 is being dispensed and retracted, thus prolonging the working life of lay out line 2.

Figure 7:
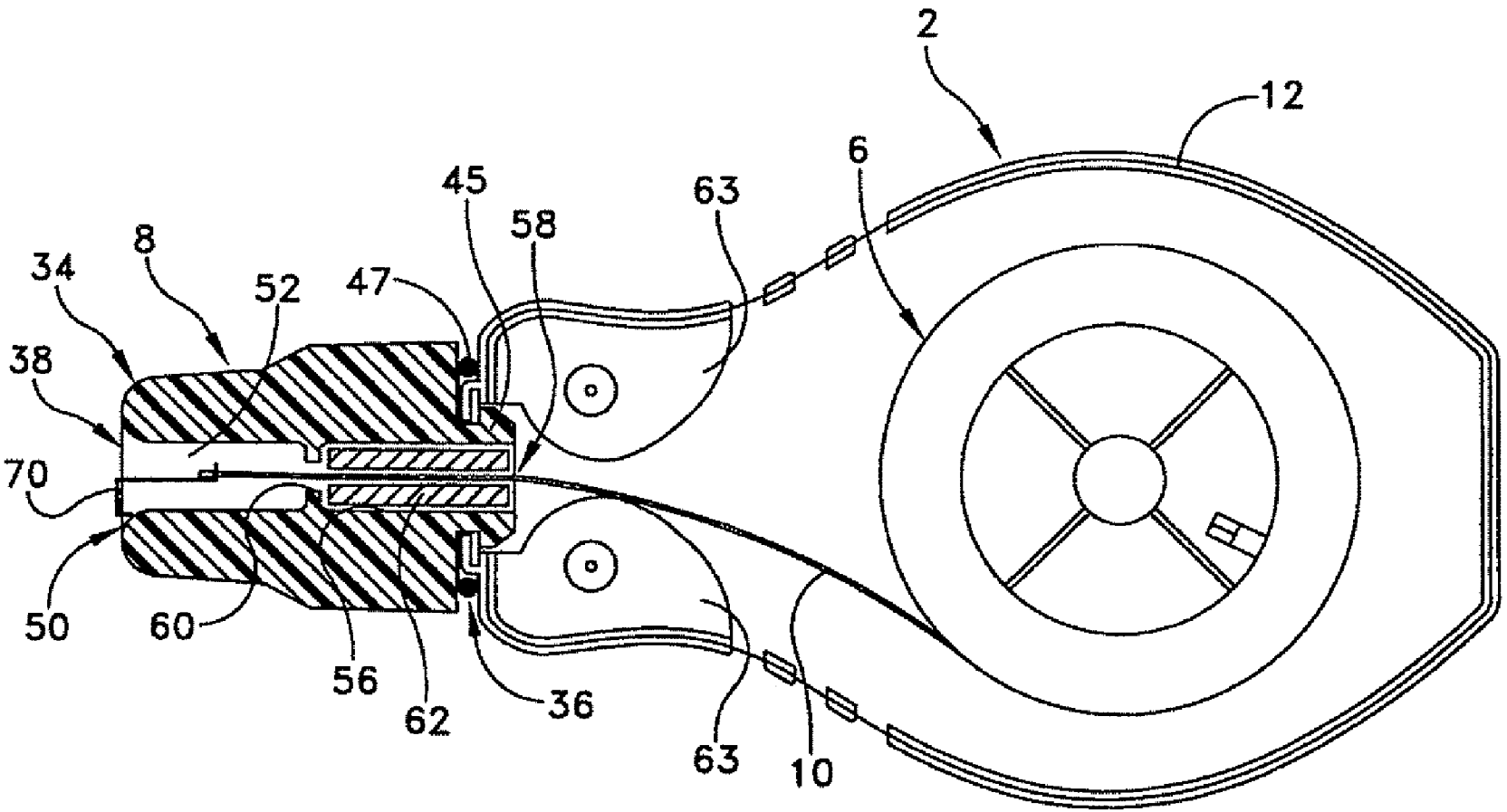
FIG. 7 is a cross-sectional view of a lay out line as taken along line 7-7 in FIG. 1.
Figure 8:
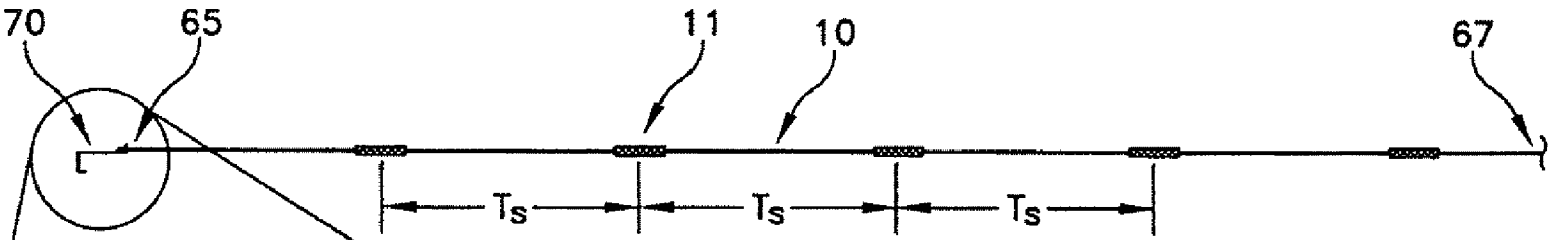
FIG. 8 is a side elevational view of a portion of a line forming a portion of the lay out line of FIG. 1.
Figure 9:
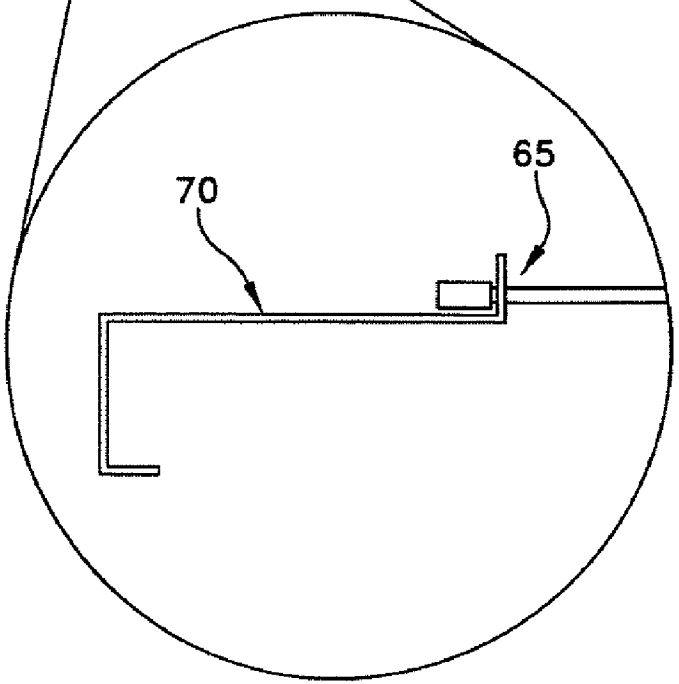
FIG. 9 is an enlarged, detail view of a hook at the free end of the line shown in FIG. 8.
Figure 10:
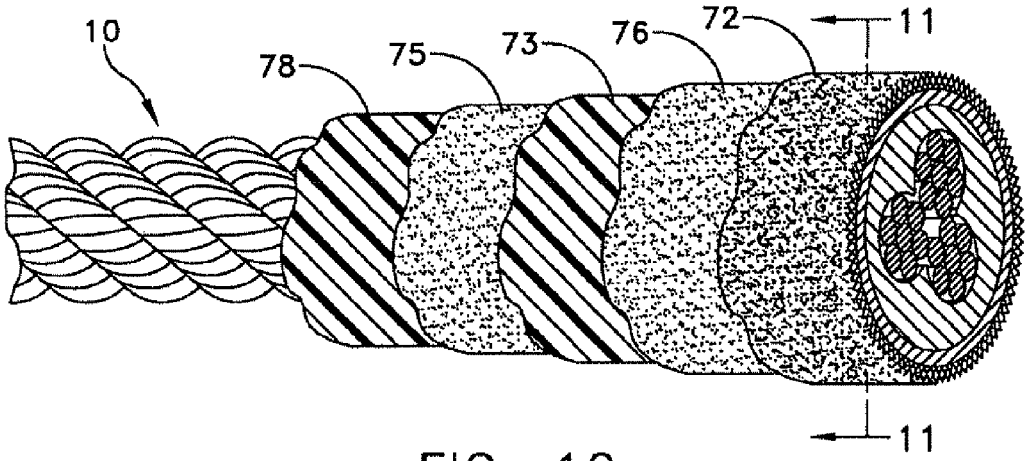
FIG. 10 is perspective and enlarged view, partially in a cross-section, of the line shown in FIG. 8.
Figure 11:
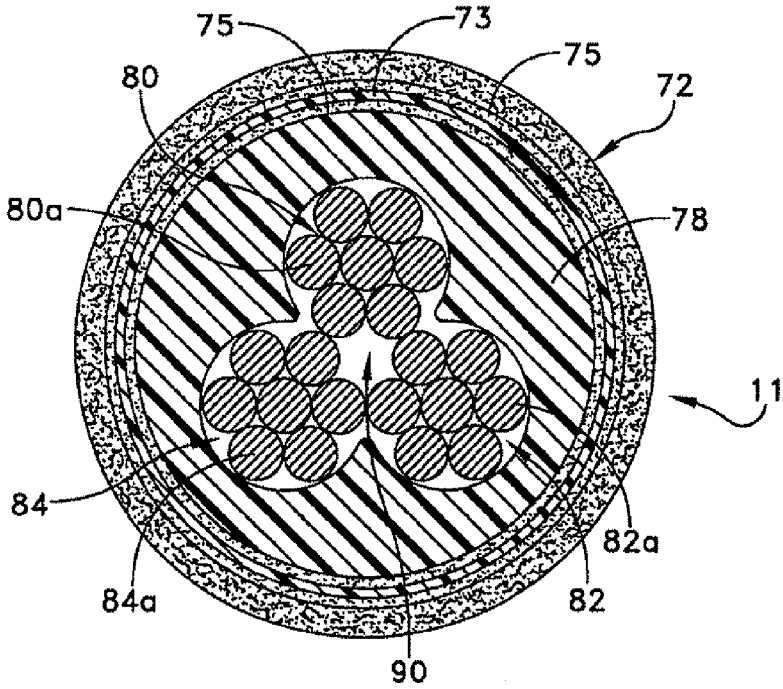
FIG. 11 is an end cross-sectional view of line shown in FIG. 10, as taken along line 11-11.

Referring to FIGS. 1, and 7-20*a*-*f*, line 10 comprises a front end 65, a rear end 67, and a plurality of regularly spaced transfer mark regions 11. More particularly, front end 65 is connected to a hook 70 and rear end 67 is fixedly secured to central cylinder 23 of spool 6. The hook 70 may be connected to the front end 65 of the line 10 in a manner that allows the hook 70 to spin with respect to the line 10, which may minimize or prevent kinking or tangling of the line 10 during rewinding. Hook 70 is configured to releasably engage a portion of a target structure. As shown in FIG. 7, the hook is also neatly engageable with the discharge end 34 of the nose piece 8 when the line 10 is fully retracted into the housing assembly 4. This engagement is an advantage because it may prevent the hook 70 from snagging other tools, etc. during storage. A plurality of transfer mark regions 11 are disposed at regularly spaced intervals along the length of line 10 for receiving powdered chalk within chamber 16 of housing assembly 4. Each transfer mark region 11 may be an individually-applied element that is adhered to the exterior coated surface of line 10 at predetermined, regular intervals, e.g., twelve, sixteen, nineteen and two tenths, or twenty-four inches or two hundred millimeters. Preferably, transfer marks regions 11 will be as thin as practically possible in order to minimize or eliminate the chance that the marks will catch on (or be otherwise damaged by) nose piece 8 or other internal surfaces of housing assembly 4 or spool 6. In one embodiment, transfer mark regions 11 comprise ultra-thin layers of felt material 72 bonded to line 10 using a polymer film 73 with adhesive layers 75, 76 applied to both sides. Polymer film 73 can enhance the stability of transfer mark regions 11 by resisting stretching and movement during tensioning.

Polymer film 73 may be coated on both sides with a thin layer of adhesive 75, 76. On one side, a thin layer of felt 72 or other porous material can be pressed into the adhesive 76 using a pinch roller or other suitable device. After pressing, felt material 72 can be sanded or shaved, using sand paper or other suitable abrasive, to remove up to about 99% of the thickness of the original applied felt, so that only an ultrathin layer (a "fuzz") of felt remains bonded to the adhesive 76. The resulting composite is then pressed together at high pressure, again using the pinch roller or other suitable device, to ensure complete adhesion of the remaining portions of felt 72 to adhesive layer 76, and the pressed composite is left to cure for about seventy-two hours at room temperature to complete the adhesion process. After curing, the composite may be cut into appropriately sized "matchstick-like" pieces using a die cutter, and applied to line 10 at the desired, precisely measured intervals. In one preferred embodiment, the composite is cut into precisely one and a half inch long matchstick-like pieces. Advantageously, transfer mark regions 11 are applied while line 10 is subjected to a tensile force substantially equal to the tensile force that will be applied during use of lay out lines. In a preferred embodiment, where line 10 comprises a multi-stranded stainless steel wire rope having a three-by-seven configuration, this tensile force will be about ten pounds, which corresponds to the force applied to line 10 just prior to reaching a "spike" in resistance, as will hereinafter be disclosed in further detail.

In a preferred embodiment, polymer film 73 is a ½-mil (twelve micron) thick polyester film, having a three mil (seventy-five micron) thick acrylic adhesive 75, 76 coating applied to each side. The resulting total composite thickness will be about three and a half mils (87 microns). Such a small thickness is important because it minimizes the chances that transfer mark regions 11 will catch on internal surfaces of either nose piece 8 or housing assembly 4, and therefore increases the life of lay out line 2. The benefit of using an acrylic adhesive is that it bonds extremely well to the nylon coating used on the outside of line 10, since after curing for seventy-two hours subsequent to its application to line 10, the acrylic adhesive cross-links with the nylon coating to form a bond of sufficient strength that it should resist peeling over the lifetime of the device. The benefit of using a polyester film material is that will not stretch, and thus it will provide a robust transfer mark region 11 of known, repeatable, and reliable length. One suitable double-coated polyester film that may be used with the present invention is a product manufactured and sold by Venture Tape®, 30 Commerce Rd., P.O. Box 384, Rockland, Mass. 02370 USA, and identified as "0.5 mil (12 micron) Double Coated Polyester Film, Product #587." Shaving/sanding of felt 72 can be performed using multiple rounds of sanding using eighty and one hundred grit sandpaper.

Line 10 often has a polymer coating 78 applied to its exterior surface, which, as previously noted, serves to resist the collection or absorption of chalk, and which is easily wiped free of any accumulated chalk by wiping element 62 when line 10 is dispensed from nose 8 of housing assembly 4. Polymer coating 78 preferably comprises nylon, polyvinylchloride (PVC), polyethylene (PE), polypropylene (PP) or other appropriate flexible polymer coatings that are suitable for protecting line 10 from damage and for resisting the accumulation of powdered chalk during operation. Line 10 preferably comprises a polymer coated multistranded metal cord or wire rope, i.e., a standard three-by-seven wire rope or cord configuration. For the purposes of this application, the term "wire rope" means a plurality of strands laid helically or simply wrapped around a centrally disposed longitudinal axis or a core. The term "strand" means an arrangement of wires or non-metallic fibers laid about and/or in substantially parallel orientation along an axis, or another wire or fiber center to produce a symmetrical section. The term "cord" means a small size wire rope. It will be understood that the designation "three" refers to the number of strands while the designation "seven" refers to the number of wires provided per strand. Thus in one preferred embodiment of the invention, line 10 advantageously comprises three strands 80, 82, 84 that are helically laid out about a longitudinal axis of line 10. In turn, each strand 80, 82, 84 individually comprises seven individual wires 80*a*, 82*a*, 84*a* which are helically laid out about the longitudinal axis of its corresponding strand 80, 82, 84. When strands 80, 82, 84 are arranged to form line 10, voids are defined between strands, the most prominent of which is a center void 90.

Alternatively, line 10 may comprise wire rope or cord made from type 302, 305 or 316 stainless steel, to provide corrosion resistance. This may be advantageous even where line 10 is coated with a polymer, since it can provide continued corrosion resistance even if the coating is abraded or otherwise compromised over the lifetime of lay out line 2. Of course, other materials, such as iron, copper alloys and the like, may also be used with the present invention with adequate results. In addition, line 10 may be made of prestretched instrumentation wire rope. Furthermore, line 10 can be provided in either lubricated or unlubricated form.

The existence of center void 90 allows line 10 to compress slightly when subjected to a tensile force. This, in turn, allows line 10 to stretch in a corresponding amount so as to increase in length slightly. Although the amount of tensile force required to compress or collapse center void 90 along at least a portion of the length of line 10 can be rather small, once center void 90 has been collapsed (FIG. 15) the amount of tensile force required to stretch line 10 by any additional amount increases substantially. Thus a tangible "spike" in resistive force can be felt when the compression limit of center void 90 within line 10 (referred to as the line "pretensioning limit" and designated at reference symbol A in FIG. 17) has been achieved. As a result, a workman (designated at reference symbol B in FIGS. 18 and 19) can easily determine when the "pretensioning limit" has been reached, without the need for gauges or other tools. This is particularly advantageous because it allows workman B to apply a predetermined and repeatable tension (resulting in a predetermined and repeatable stretch) to line 10 without the need for any other equipment. Significantly, since line 10 will have a known length when subjected to the "pretensioning limit," transfer mark regions 11 can be applied to line 10 when the line is in this tensioned configuration. A workman B can therefore be assured that when line 10 is tensioned to this tangible pretensioning limit at a job site, transfer mark regions 11 will be positioned exactly at the locations desired prior to snapping line 10. This simple and repeatable tensioning is not possible with prior art string lines or with single-wire lines because neither has the same tangible tensioning limit. As a result, prior art devices can not provide the desired assurance that the resulting markings will be placed at the appropriate locations on the construction surface. This repeatable tensioning obtained with the inventive device meets National Institute of Standards and Technology (NIST) standards for tape measure accuracy.

In an exemplary, non-limiting embodiment, the pretensioning limit corresponds to an axial stretch of about 0.001-inch to about 0.0011-inch per linear foot of line 10. In preferred embodiment, the pretensioning limit corresponds to a total axial stretch of about 5/16-inch in a line 10 having a length of about 25-feet.

Figure 20A:
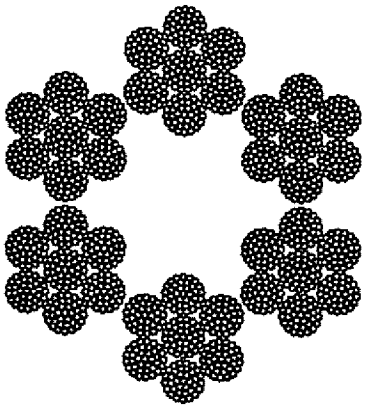
FIGS. 20*a*-20*f* are cross-sectional views showing alternative embodiments of the line for use in the lay out line of FIG. 1.
Figure 20B:
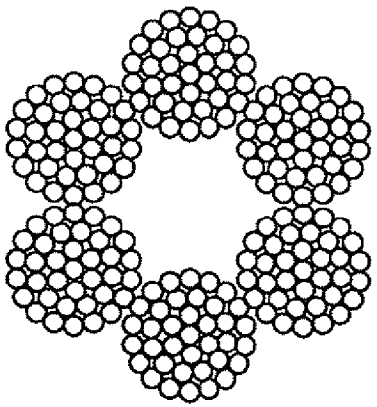
Figure 20C:
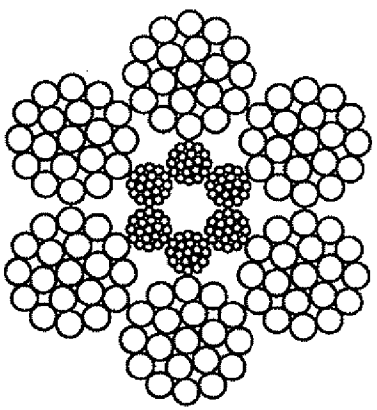
Figure 20D:
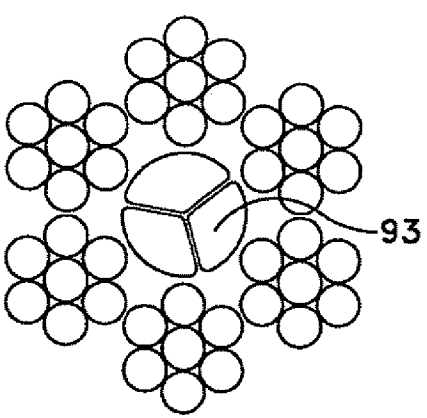
Figure 20F:
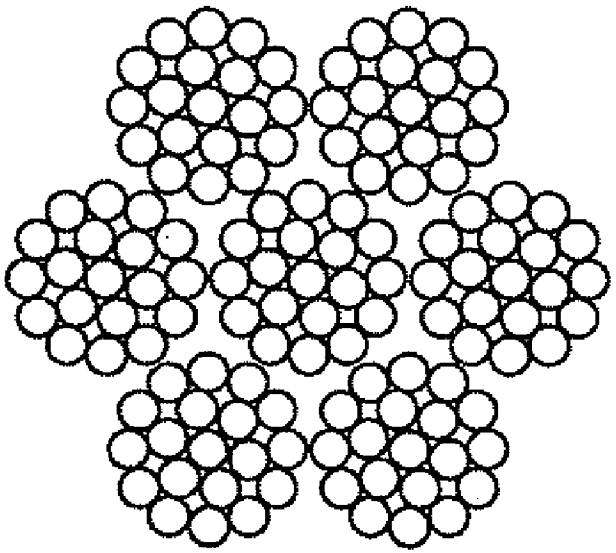
Figure 20E:
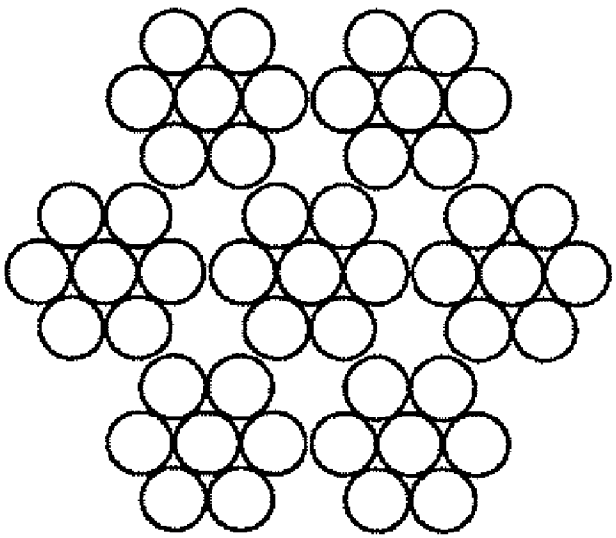

In one preferred embodiment, line 10 comprises a 1/32" diameter, nylon coated, unlubricated, three-by-seven stainless steel wire rope. However, although the preferred embodiment is a three-by-seven configuration, other wire and strand configurations can also be used for line 10, including configurations having fiber cores, etc., as long as they posses the desired characteristics of having a known pretensioning limit that provides a known and repeatable stretch, and which is tangible to the user, for the reasons previously described. FIGS. 20*a-d* show various alternative wire rope configurations, such as a six-by-seven hollow core configuration (FIG. 20*a*), a six-by-thirty-seven hollow core configuration (FIG. 20*b*), a six-by-nineteen and six-by-nineteen combination configuration (FIG. 20*c*), a six-by-seven configuration with a polymer core 93 (FIG. 20*d*), a seven-by-seven strand core configuration (FIG. 20*e*) and a seven-by-nineteen strand core configuration (FIG. 20*f*). It should also be noted, however, that increases in the number of wires and strands generally will result in increased weight and decreased flexibility of line 10, and thus may be impractical for general use.

Once again, line 10 will preferably be tensioned, after it has been laid out on the building structure, just prior to marking.

As is common in residential construction, studs are often located on sixteen inch centers. Thus, when tensioned to the "pretensioning limit," line 10 will stretch by the amount necessary to position the centers of adjacent transfer marks 11 at exactly sixteen inches apart. It will be obvious to one of ordinary skill in the art that although a sixteen inch distance between centers is disclosed, other distances can be used, such as twenty-four inches (common in commercial constructions) or others, e.g. corresponding to European or other foreign configurations.

Figure 21:
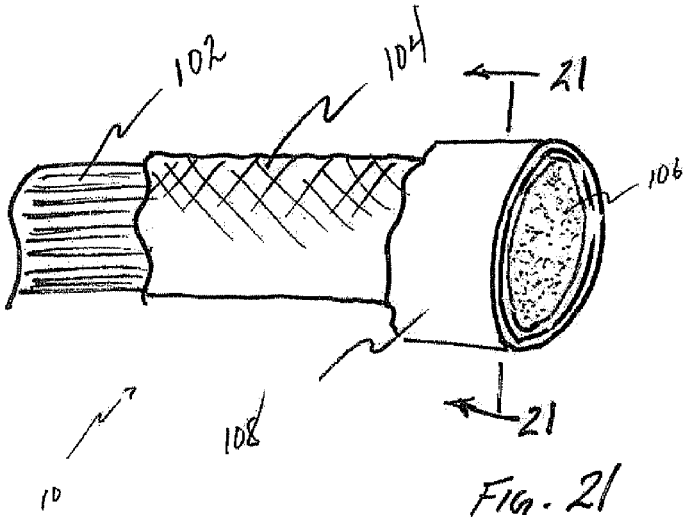
FIG. 21 is a cutaway perspective view of a further embodiment of the line for use in the lay out line of FIG. 1.
Figure 22:
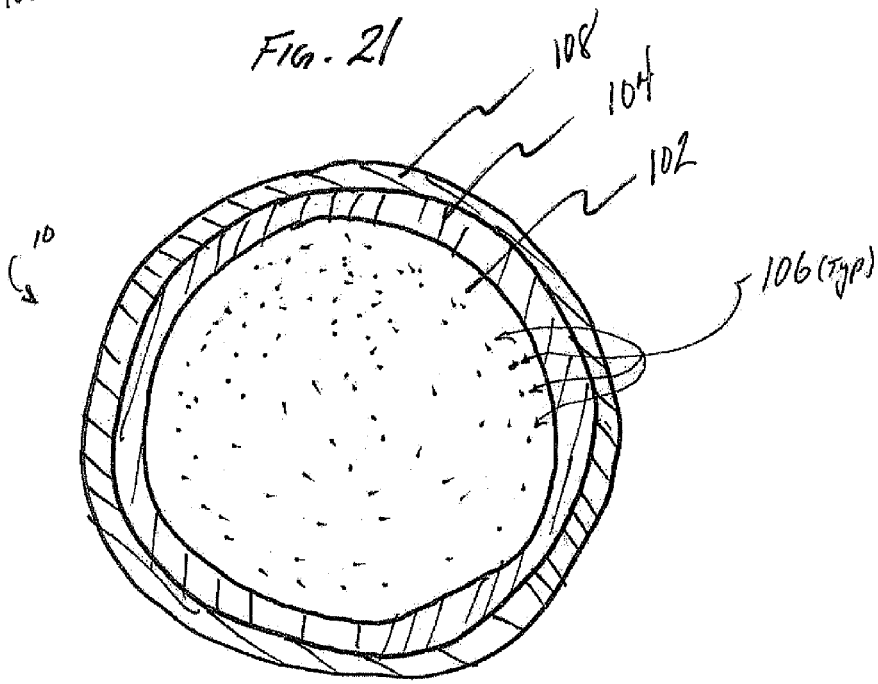
FIG. 22 is a cross-sectional view of the line of FIG. 21 taken along line 21-21.

In another preferred embodiment, shown in FIGS. 21 and 22, line 10 comprises an all-polymer construction. In this embodiment, line 10 has an Aramid fiber core 102 surrounded by a braided polyester jacket 104. In the illustrated embodiment, the individual fibers 106 in the Aramid fiber core 102 are aligned to be substantially parallel to the longitudinal axis of the line 10, thus providing desired low stretch characteristics to the line 10. It will be appreciated, however, that the fibers 106 of the core 102 could also be provided in twisted or woven configurations and will still provide desired low-extensibility characteristics. Acrylic coated segments 108 may be provided along the length of the line 10 at the same locations as the "transfer mark regions" 11 previously described in relation to FIG. 8 to provide stud location indications.

With this non-metallic embodiment, the outer surface of the braided polyester jacket 104 can collect and retain chalk, whereas the acrylic coated segments 108 will not (i.e., the chalk will be easily wiped free from the surface of the segments 108 by wiping element 62 when line 10 is dispensed from nose 8 of housing assembly 4). Thus, when the line 10 is tensioned and "snapped," a chalk line will be applied across the length of the wall surface except for the portions underlying the segments 108. The blank, or unlined, spaces on the wall will signify the precise locations of the underlying wall studs (or the locations in which the wall studs should be placed if the line is snapped against a top or bottom wall plate). This arrangement is of benefit because it provides a chalk marking on the wall surface nearly the entire length of the line 10, thus allowing the line 10 to be used for twin purposes: (1) as a wall stud marker, and (2) as a traditional chalk line.

As will be appreciated, discontinuities on the surface of the line 10 will serve to retain chalk, while a smooth surface will serve to repel chalk (or allow the chalk to be wiped off when the line is dispensed from the housing). In the case of the embodiment of FIGS. 21 and 22, the "discontinuities" are inherent in the weave of the braided polyester jacket. As described in more detail below, these "discontinuities" in the line 10 can be implemented in a variety of ways (e.g., chemical or mechanical abrasion, felt, flocking), all of which are contemplated as being appropriate for use with this all-polymer construction.

Thus, in a further preferred embodiment, the line 10 comprises a plurality of substantially parallel Aramid core fibers 106, with an acrylic coating flocked with wool covering the core fibers 106 over the entire length of the line. An additional acrylic coating is applied over the flocked acrylic at the discrete transfer mark regions 11. Thus, when chalk is applied to this line and dispensed from the housing, chalk is retained by the exposed wool-flocked portion of the line and is repelled (wiped off) at the acrylic coated transfer mark regions 11. When the line is tensioned and snapped against a work surface, a chalk line will be applied across the length of the wall surface except for the portions underlying the acrylic coated "transfer mark regions 11." The blank, or unlined, spaces on the wall will signify the precise wall stud locations.

It will be appreciated that instead of applying the additional acrylic coating at the discrete transfer mark regions 11, the pulverized wool "flocking" could be eliminated at these locations to provide the desired chalk-repellant regions 11. This could be done by masking those regions during the flocking process, or alternatively the flocking (wool) could be removed subsequent to the flocking process by sanding, shaving or the like.

As noted, the Aramid fiber core 102 is comprised of a plurality of individual parallel aligned Aramid fibers 106. These parallel Aramid fibers provide the line 10 with desired low-stretch properties so that when the line is tensioned and "snapped," the stud location indications will have a highly accurate and highly repeatable predetermined spacing.

The braided polyester jacket 104 (for the embodiment of FIGS. 21 and 22), in addition to having beneficial chalk collection and retention properties, also provides a protection function for the Aramid fiber core 102. Specifically, the tight braid of the jacket 104 substantially prevents chalk from penetrating to the core 102 during use. This can be important because if the core 102 absorbs a substantial amount of chalk during operation, the core 102 can swell, causing the linear spacing between segments 108 to change (i.e. shorten), and resulting in inaccurate placement of the stud location indications.

To further enhance protection of the core 102 against absorption of chalk, an adhesive layer 110 may be provided between the core 102 and the braided polyester jacket 104.

It will be appreciated that the individual Aramid fibers 106 used to make up core 102 have a high modulus of elasticity, and thus they will stretch very little during operation. This is important because it ensures repeatable, accurate, placement of stud indications (segments 108) throughout the life of the line 10. In addition to this, structural stretch in the line (that caused by voids between the individual fibers, fiber lay and the like), may be minimized by placing the fibers 106 under a uniform tension during manufacture prior to application of the braided jacket 104 (or flocking).

While the line 10 is manufactured so that the individual core fibers 106 have a high degree of parallelism, it it believed that slight voids (not shown) will still exist between the fibers 106 so that when the a tensile force is applied to the finished line 10, the line will compress slightly. As with the previous embodiments, this allows line 10 to stretch in a corresponding amount so as to increase in length slightly. Although the amount of tensile force required to compress or collapse these voids can be rather small, once the voids have been collapsed the amount of tensile force required to stretch line 10 by any additional amount increases substantially. Thus a tangible "spike" in resistive force can be felt when the compression limit of the line 10 (referred to as the line "pretensioning limit") has been achieved. As a result, a workman (designated at reference symbol B in FIGS. 18 and 19) can easily determine when the "pretensioning limit" has been reached, without the need for gauges or other tools. This is particularly advantageous because it allows workman B to apply a predetermined and repeatable tension (resulting in a predetermined and repeatable stretch) to line 10 without the need for any other equipment. A workman B can therefore be assured that when line 10 is tensioned to this tangible pretensioning limit at a job site, segments 108 will be positioned exactly at the locations desired prior to snapping line 10. This simple and repeatable tensioning is not possible with prior art string lines or with single-wire lines because neither has the same tangible tensioning limit. As a result, prior art devices can not provide the desired assurance that the resulting stud location indications will be placed at the appropriate points on the construction surface. This repeatable tensioning obtained with the inventive device meets National Institute of Standards and Technology (NIST) standards for tape measure accuracy.

It is noted that this "pretensioning limit" is also expected for those lines in which the polymer fiber core is twisted or woven, thus providing a similar repeatable and accurate positioning of markings on a wall surface without the need for additional equipment.

In one exemplary embodiment, the pretensioning limit of the Aramid core line corresponds to a total axial stretch of about ⅜-inch to about ½-inch in a line 10 having a length of about 25-feet. This also corresponds to the application of about 10-15 lbs of tensioning force by the workman. Preferably this will correspond to the application of about 13 lbs of tensioning force by the workman.

In one exemplary embodiment of the line 10 of FIGS. 21 and 22, the Aramid fiber core 102 may comprise 6-strands, with each strand having a linear density of 1610 DTEX. Such 1610 DTEX strands may be referred to commercially as Twaron 2200. The woven polyester fiber jacket 106 may comprise a 30 PPI polyester braided jacket. One commercial source for these materials is Cortland Cable Company, 44 River St., Cortland, N.Y., 13045. Additionally, the stud-location segments 108 may comprise an acrylic water based coating, such as "Product HCF" offered by Plasti Dip International, 3920 Pheasant Ridge Drive, Blained Minn. 55449.

It will be appreciated that although the core 102 of this embodiment has been described as being made from Aramid fibers, other fiber materials may also be used for core 102 as long as they comprise similar desirable low-stretch properties. Likewise, the jacket 106 need not be made from braided polyester, as long as the material and braid/weave used is capable of collecting/retaining powdered chalk for marking, and is resistant to the passage of chalk material through to the core 102.

Additionally, segments 108 may be made from material other than acrylic, as long as the material used is appropriately flexible, durable, and resists the collection and retention of chalk in operation. A non-limiting list of exemplary acceptable coating materials include nylon, polyvinylchloride (PVC), polyethylene (PE), and polypropylene (PP).

Advantages of the all-polymer embodiment of FIGS. 21 and 22 are that it is lighter than metal versions (thus enabling the user to more easily pull a true horizontal line), that the line can function universally as both a standard chalk line and a stud marking line, that it resists permanent kinking, and that it has exceptional strength.

Figure 19:
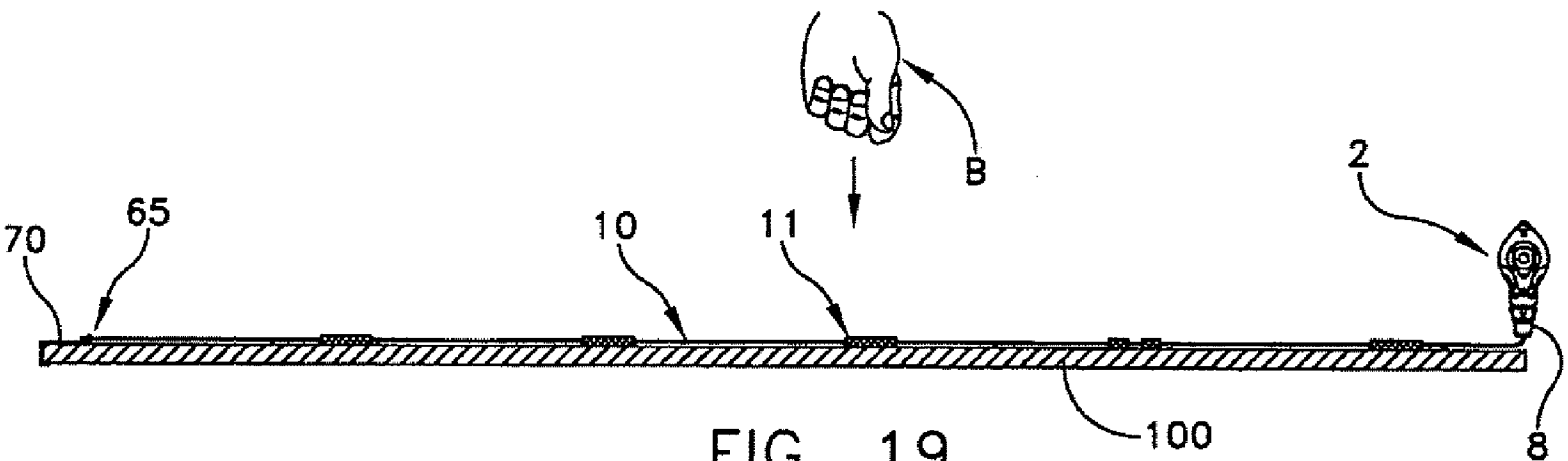

Referring to FIGS. 14-19, the tensioning and marking process is shown in reference to a structural element 100, e.g., top or bottom plate to which wall studs will be attached to form the interior structure of a wall, floor or ceiling, or roof. Hook member 70 is attached to one end of board 100, and line 10 is dispensed from nose piece 8 via discharge opening 54 of front cavity 52 so that housing assembly 4 is located at the opposite end of board 100. In this arrangement, line 10 has an initial (untensioned) length "$L_1$." Thereafter, crank handle 28 can be locked to the outer surface of housing half 12 while housing assembly 4 is rotated about 90° (FIG. 16) so that line 10 bears against bearing surface 50 of nose piece 8. Workman B can then pull on line 10 until a noticeable increase, or "spike", in resistive force is felt, which corresponds to pretensioning limit" A, the predetermined tension. At this stage, line 10 will have a tensioned length "$L_2$" that is greater than untensioned length "$L_1$," such that the centers of adjacent transfer mark regions 11 will be separated by exactly the desired distance "$T_S$" for marking the stud locations. Line 10 can then be snapped by drawing it up and away from the surface of board 100 (FIG. 18) and then releasing it (FIG. 19). The impact force of line 10 and transfer mark regions 11 against the outer surface of board 100 causes the chalk on transfer mark regions 11 to be applied at the desired locations on the board surface thereby precisely and accurately marking the locations for the wall studs. A similar process can be used for marking the locations of existing studs under drywall or like sheathing (such as would be done when installing trim). In such a case, hook member 70 could be attached to a nail or screw driven into the wall sheathing.

It will be appreciated that although transfer mark regions 11 have been described in relation to elements that are adhered to the exterior surface of line 10, they could also be provided integral to the surface of line 10. Thus, in one alternative embodiment, transfer mark regions could comprise discontinuities in the surface coating of line 10 formed through exposure to a strong acid or base or other appropriate technique known in the art (e.g. mechanical abrasion). These discrete discontinuities can be sufficient to retain powdered chalk material in a manner similar to that of the previously described transfer mark regions 11, and can be simpler to manufacture and would not be susceptible to lifting or "catching" as could occur with raised transfer mark regions 11. Thus, for the purposes of this application, the term "discontinuities" means any one of the following: felt applied to the line, chemically or mechanically abraded regions of the line, uncoated regions of the line, a braided jacket covering, or flocked sections of line (flocking comprising the application of particles of pulverized wool, felt, cotton, foam or the like to the line via adhesive or embedding such particles in a coating applied to the line).

Additionally, it will be appreciated that although the illustrated embodiments show transfer mark regions 11 as being configured to retain powdered chalk material so as to apply chalk at the precise locations for the underlying wall studs, other marking schemes can also be used. In one exemplary embodiment, an "inverse marking" scheme may be applied, in which the line 10 may be provided without a polymer coating 78, except at those specific locations on the line designated as the "transfer mark regions 11" in FIGS. 8, 14, 16, 18 and 19. As a result, the uncoated line 78 will retain powdered chalk material, while the polymer coated "transfer mark regions 11" will be wiped free of accumulated chalk when line 10 is dispensed from nose 8 of the housing assembly 4. In application, when the line is tensioned and "snapped," a chalk line will be applied across the length of the wall surface except for the portions underlying the "transfer mark regions 11." The blank, or unlined, spaces on the wall will signify the precise locations of the underlying wall studs. It will be appreciated that any of the aforementioned "discontinuity" schemes can be used to implement this "inverse marking" scheme. For example, the line 10 may be provided with felt, may be chemically or mechanically abraded, or provided uncoated or flocked except at those specific locations on the line designated as the "transfer mark regions 11." Alternatively, the entire line may be provided with one or more of the listed "discontinuities," and a chalk-repellant polymer coating may then be provided at the discrete "transfer mark regions 11."

Likewise, in a second alternative embodiment, varying degrees of roughening may be applied over the length of the line 10 (or the line may simply be provided without the polymer coating 78, with more pronounced roughened surface portions located at the "transfer mark regions 11" of FIGS. 8, 14, 16, 18 and 19. As a result, the portions of the line 10 at the "transfer mark regions" may retain more powdered chalk material than the remainder of the line 10 when the line 10 is dispensed from nose 8 of the housing assembly 4. In application, when the line is tensioned and "snapped," a chalk line will be applied across the entire length of the wall surface, with more pronounced chalk markings applied to the wall surface beneath the "transfer mark regions 11." The more pronounced chalk markings will signify the precise locations of the underlying wall studs.

Other such marking schemes may also be implemented without departing from the scope of the invention, as long as the resulting chalk markings adequately identify to the user the locations of the underlying wall studs or other targeted structures.

Figure 12:
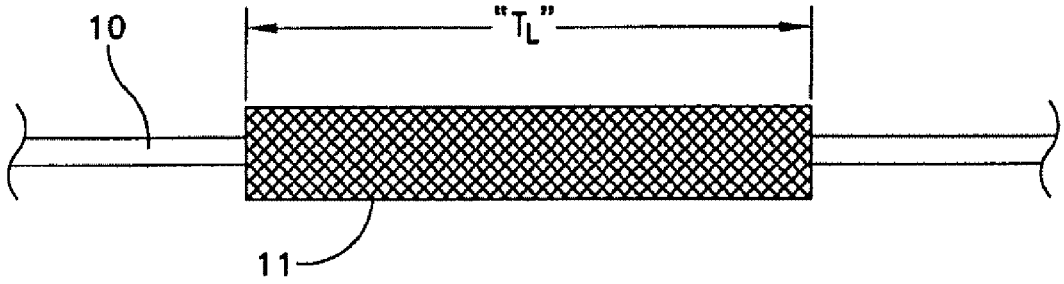
FIGS. 12 and 13 are side elevational views of a single and double transfer mark region, respectively, that may form a portion of the line shown in FIG. 8.
Figure 13:
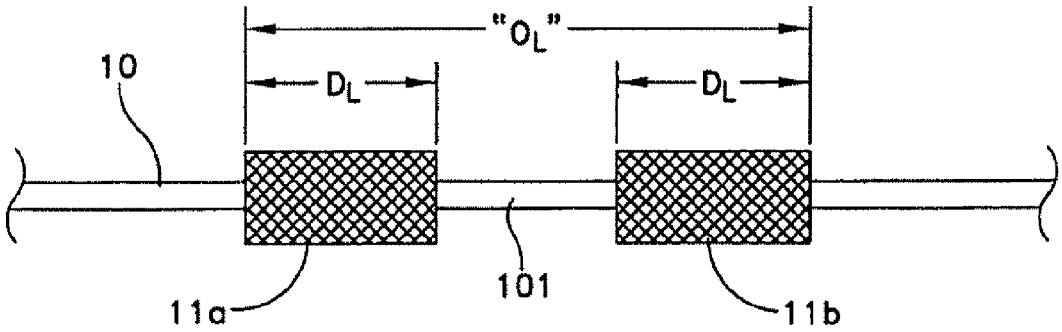
Figures 14, 15, 16, 17:
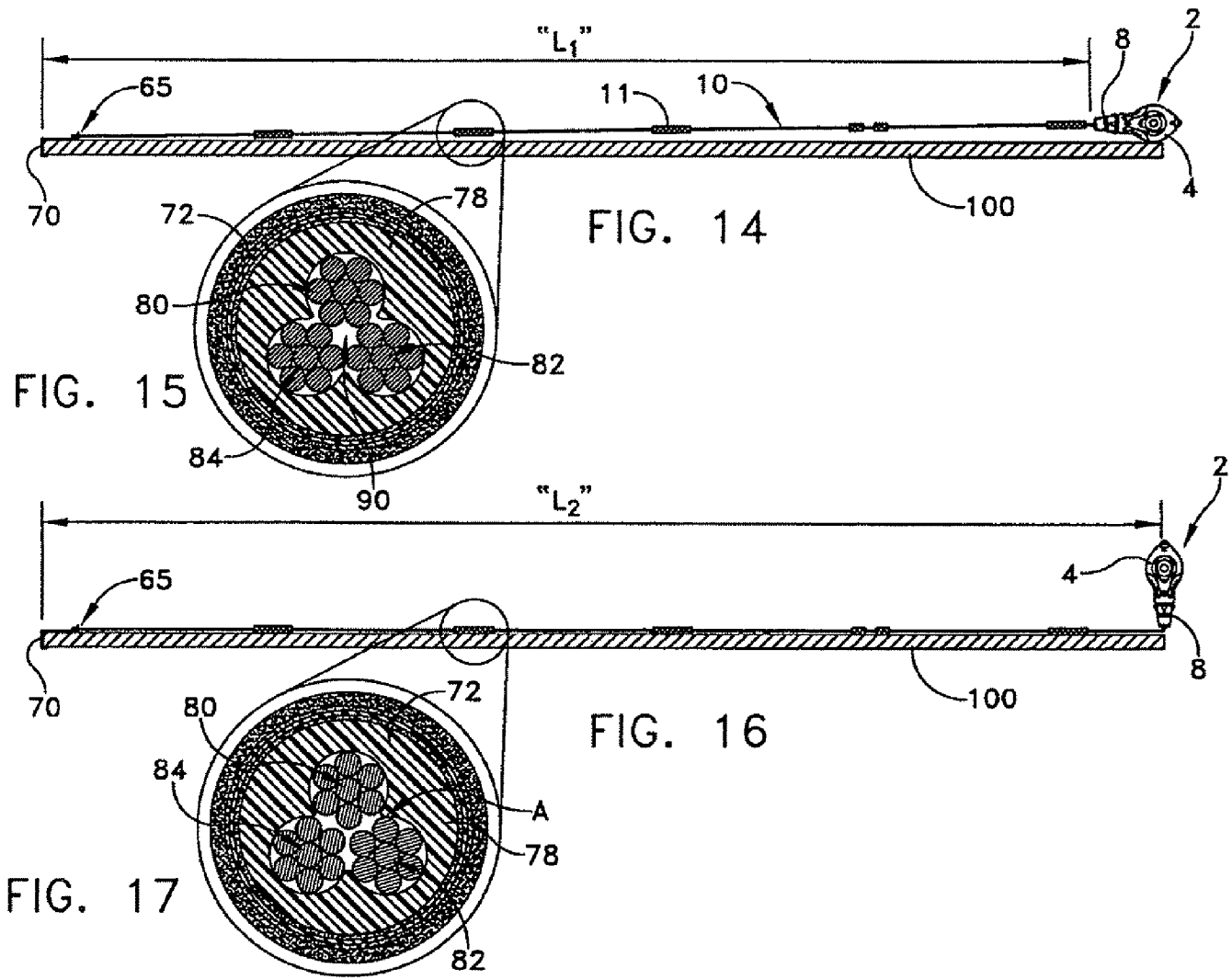
FIGS. 14, 15, 16, 17, 18, and 19 illustrate a sequential operation of the lay out line of FIG. 1, for producing chalk line markings on the surface of a structure.
Figure 18:
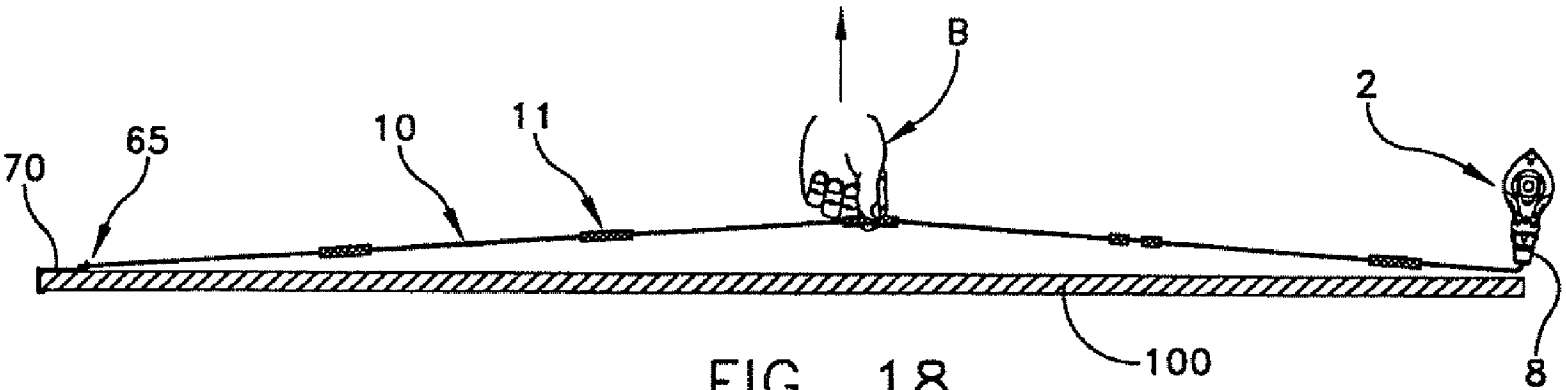

In a further embodiment, two different marks can be provided on a single line, as shown in FIGS. 12 and 13. The single-mark variety of FIG. 12, can have an axial length "TL" of about one and a half inches to correspond to the width of a standard wall stud. The benefit of providing a mark of one and a half inches in length is that it identifies to the framing workman B the exact location for placement of the side edges of the stud, without the need for additional measuring or marking (as previously noted, traditional methods involve the multistep process of marking the sixteen inch point, then measuring ¾-inches on either side to identify the points for placement of the stud side edges). Likewise, for a trim carpenter the 1.5 inch mark will show the exact location, from side edge to side edge, of the stud underlying the wall sheathing, again eliminating the need for further measuring or marking. The double-mark variety of transfer mark region 11 shown in FIG. 13 may be used to identify specific length locations of interest to workman B. For example, the double-mark can be used to identify the four, eight and twelve foot marks along the targeted structure. The outside length "$O_L$" of the double-mark can be 1.5 inches, the same as that of the single-mark variety, with the difference being that the mark is formed by two short mark segments 11*a*, 11*b* each having a length "$D_L$" less than half the outside length $O_L$, such that they are separated by a short central portion 101 having no surface discontinuity. As such, a dashed chalk mark will be applied using this structure. The double mark segments 11*a*, 11*b* provide a quick visual indication to workman B of the location for specific points of interest (e.g. the four, eight and twelve foot points on a structure). It will be appreciated that although a double-mark is disclosed for identifying the four, eight and twelve marks along a structure, that other appropriate visual indicia could also be provided.

It is to be understood that the present invention is by no means limited only to the particular constructions herein disclosed and shown in the drawings, but also comprises any modifications or equivalents within the scope of the claims. For example, any of a variety of line types may be used, including covered or coated multi-strand wire rope or coated or covered multi-strand engineered fibers. Suitable coatings for such lines may be nylon, acrylic, or other appropriate polymers. Suitable coverings may be woven polyester, or woven polyester fixed to the line with adhesive.

The invention claimed is:

1. A tensioned chalk line apparatus, comprising:

a chalk line comprising a multi-strand line, said chalk line having a relaxed configuration in which substantially no tensile force is applied to said chalk line and a tensed configuration in which a predetermined tensile force is applied to an end of said chalk line, said chalk line further having a length that is shorter in said relaxed configuration than in said tensed configuration;

said chalk line further having a plurality of surface discontinuities spaced at predetermined intervals along a length of said chalk line;

wherein at least one of said plurality of surface discontinuities comprises a thin layer of material having a surface repellant to a chalk material so that chalk is repelled by said surface discontinuities and is selectively adhered to portions of said chalk line located between adjacent surface discontinuities to provide a chalk line capable of producing a multiplicity of aligned, accurately spaced chalk marks on a surface in said tensed configuration.

2. The tensioned chalk line apparatus of claim 1, further comprising:

a case having a compartment for holding chalk material and having an exit opening at one end; and a reel rotatably mounted in said case;

wherein said chalk line is wound on said reel and extends from said reel through said exit opening to said outside of said case.

3. The tensioned chalk line apparatus of claim 2, further comprising a nose piece disposed adjacent said exit opening and removably engageable with said case, said nosepiece having a central cavity for receiving said chalk line therethrough, said central cavity having a wiping member for pressing chalk into said surface discontinuities and wiping accumulated chalk from portions of said chalk line located between adjacent surface discontinuities.

4. The tensioned chalk line apparatus of claim 3, wherein said multi-strand line comprises a plurality of substantially parallel polymer fibers, the multi-strand line further comprising a flocked coating encasing said plurality of substantially parallel polymer fibers.

5. The tensioned chalk line apparatus of claim 4, wherein said chalk line has an extensibility limit corresponding to said tensed configuration, said chalk line providing tangible feedback to a user as a substantially increased tensile resistance in response to said application of tensile forces in excess of said predetermined tensile force.

6. The tensioned chalk line apparatus of claim 4, wherein said polymer fibers comprise Aramid and said flocked coating comprises acrylic with pulverized wool.

7. The tensioned chalk line apparatus of claim 6, wherein at least a first one of said plurality of surface discontinuities has a length of about 1.5 inches, and at least second and third ones of said plurality of surface discontinuities are sized and spaced such that a distance from a first end of said second mark to a second end of said third mark is about 1.5 inches, and wherein an individual length of each said second and third marks is less than 0.75 inches.

8. An apparatus for applying a plurality of regularly spaced marks to a surface comprising:

a chalk line comprising a plurality of polymer strands having spaces therebetween, said chalk line having (i) a relaxed configuration in which at least some of said spaces have a first cross sectional area, and (ii) a tensed configuration in which a predetermined tensile force is applied to an end of said chalk line; said spaces have a second cross sectional area in said tensed configuration that is smaller than said first cross sectional area; said tensed configuration corresponding to an extensibility limit of said chalk line such that said chalk line provides tangible feedback to a user as a substantially increased tensile resistance in response to said application of tensile forces in excess of said predetermined tensile force; and a plurality of surface discontinuities disposed along a length of said chalk line, such that said chalk is (a)

repelled by each of said surface discontinuities but (b) selectively adhered to portions of said chalk line located between adjacent surface discontinuities;

wherein the portions of said chalk line located between adjacent surface discontinuities have a surface, the surface being selected from the list consisting of a braided jacket, a chemically abraded surface, a mechanically abraded surface, felt, and a flocked surface;

wherein when said chalk line is in said tensed configuration said plurality of surface discontinuities are spaced at predetermined intervals along said length of said chalk line such that a multiplicity of aligned, accurately spaced chalk marks can be applied to a surface when said chalk line is impacted against said surface in said tensed configuration.

9. The tensioned chalk line apparatus of claim 8, further comprising a flocked coating encasing said plurality of polymer strands.

10. The tensioned chalk line apparatus of claim 9, wherein said plurality of polymer strands are substantially parallel to a longitudinal axis of the line.

11. The tensioned chalk line apparatus of claim 10, wherein the plurality of substantially parallel polymer strands comprise Aramid fibers.

12. The tensioned chalk line apparatus of claim 11, wherein the chalk line comprises 6 strands of Aramid fibers, each strand having a linear density of about 1610 DTEX, and wherein the braided polymer jacket comprises polyester.

13. The tensioned chalk line apparatus of claim 12, wherein the flocked coating comprises acrylic with pulverized wool.

14. The tensioned chalk line apparatus of claim 8, wherein at least a first one of said plurality of surface discontinuities has a length of about 1.5 inches, and at least second and third ones of said plurality of surface discontinuities are sized and spaced such that a distance from a first end of said second mark to a second end of said third mark is about 1.5 inches, and wherein an individual length of each said second and third marks is less than 0.75 inches.

15. An apparatus for applying a plurality of regularly spaced marks to a surface comprising:

a chalk line comprising a plurality of polymer strands having spaces therebetween, said chalk line having (i) a relaxed configuration in which at least some of said spaces have a first cross sectional area, and (ii) a tensed configuration in which a predetermined tensile force is applied to an end of said chalk line; said spaces have a second cross sectional area in said tensed configuration that is smaller than said first cross sectional area; said tensed configuration corresponding to an extensibility limit of said chalk line such that said chalk line provides tangible feedback to a user as a substantially increased tensile resistance in response to said application of tensile forces in excess of said predetermined tensile force; and a plurality of surface discontinuities disposed along a length of said chalk line, such that said chalk is (a) selectively adhered to each of said surface discontinuities but (b) repelled by portions of said chalk line located between adjacent surface discontinuities;

wherein when said chalk line is in said tensed configuration said plurality of surface discontinuities are spaced at predetermined intervals along said length of said chalk line such that a multiplicity of aligned, accurately spaced chalk marks can be applied to a surface when said chalk line is impacted against said surface in said tensed configuration.

16. The apparatus of claim 15, wherein said surface discontinuities are selected from the list consisting of a braided jacket, a chemically abraded surface, a mechanically abraded surface, a felt surface, and a flocked surface.

17. The apparatus of claim 15, wherein said chalk line has an extensibility limit corresponding to said tensed configuration, said chalk line providing tangible feedback to a user as of a substantially increased tensile resistance in response to an application of tensile forces in excess of said predetermined tensile force.

18. The apparatus of claim 15, wherein said line further comprises a flocked coating encompassing the plurality of polymer strands.

19. The apparatus of claim 18, wherein at least one of said plurality of surface discontinuities has a length of about 1.5 inches.

20. The apparatus of claim 19, wherein at least a first one of said plurality of surface discontinuities has a length of about 1.5 inches, and at least second and third ones of said plurality of surface discontinuities are sized and spaced such that a distance from a first end of said second mark to a second end of said third mark is about 1.5 inches, and wherein an individual length of each said second and third marks is less than 0.75 inches.

* * * * *